US009182703B1

(12) United States Patent
Sato

(10) Patent No.: US 9,182,703 B1
(45) Date of Patent: Nov. 10, 2015

(54) TONER CONTAINER AND IMAGE FORMING APPARATUS

(71) Applicants: KABUSHIKI KAISHA TOSHIBA, Tokyo (JP); TOSHIBA TEC KABUSHIKI KAISHA, Tokyo (JP)

(72) Inventor: Tsutomu Sato, Izunokuni Shizuoka (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/661,807

(22) Filed: Mar. 18, 2015

(51) Int. Cl.
*G03G 15/08* (2006.01)

(52) U.S. Cl.
CPC .... *G03G 15/0868* (2013.01); *G03G 2215/0668* (2013.01)

(58) Field of Classification Search
CPC ..... G03G 15/0868; G03G 15/0875; G03G 2215/0668
See application file for complete search history.

(56) References Cited

U.S. PATENT DOCUMENTS

| | | | | |
|---|---|---|---|---|
| 7,957,680 | B2 * | 6/2011 | Sato | 399/263 |
| 8,639,155 | B2 * | 1/2014 | Kato | 399/107 |
| 2008/0170887 | A1 * | 7/2008 | Nishimura et al. | 399/262 |
| 2013/0308986 | A1 | 11/2013 | Sato | |

* cited by examiner

*Primary Examiner* — Gregory H Curran
(74) *Attorney, Agent, or Firm* — Patterson & Sheridan, LLP

(57) ABSTRACT

A toner container comprises a container main body having a toner discharge port, a toner conveying section having an auger and a mixer, a handle at a first end portion of the container main body, a toner filling port at a second end portion of the container main body, a cap covering the toner filling port, a cylindrical supporting section positioned at a central part of the cap, a first gear positioned at one end portion of the mixer and configured to rotate the mixer and having a rotary axis inserted into the cylindrical supporting section, a coupling member configured to transmit rotation force from a driving device to the auger, and a second gear which rotates with the coupling member and is engaged with the first gear so that the first gear rotates when the driving device transmits rotation force from the driving device.

10 Claims, 7 Drawing Sheets

TONER CONTAINER AND IMAGE FORMING APPARATUS

FIELD

Embodiments described herein relate to a toner container for supplying toner to a developer, and method for forming an image on the image receiving medium with the developer in an image forming apparatus of the electrophotographic recording type.

BACKGROUND

Generally, in an image forming apparatus of the electrophotographic recording type, an electrostatic latent image is formed by irradiating laser beam on a photoconductive drum. The photoconductive drum forms a toner image with the toner supplied from a developer, and then the toner image on the photoconductive drum is transferred to a paper to form an image thereon. In the developer, the toner is replenished from a toner container when the toner in the developer is insufficient.

In addition, the toner container is provided with a toner filling port arranged at one end portion positioned on the front side of the image forming apparatus. In addition, a handle for inserting the toner container into or removing the toner container from the image forming apparatus is also arranged at the same end portion. In recent years, there has been a demand for a reduction in size of the image forming apparatus. As a result, the size of the toner container has also been required to be reduced.

However, the size of the toner filling port cannot be too small since the filling efficiency is deteriorated if it is set too small. In addition, from the viewpoint of operability, the size of the handle also cannot be too small. Thus, there remains a problem that the handle becomes smaller in a case of increasing the size of the toner filling port, and the toner filling port becomes smaller in a case of increasing the size of the handle.

In addition, a rotary axis of a mixer for stirring toner is installed at one end portion of the toner container. It is necessary to arrange the toner filling port at a position that avoids the rotary axis. However, there is also a limit in the increase of the size of the toner filling port.

DETAILED DESCRIPTION

Figure 1:
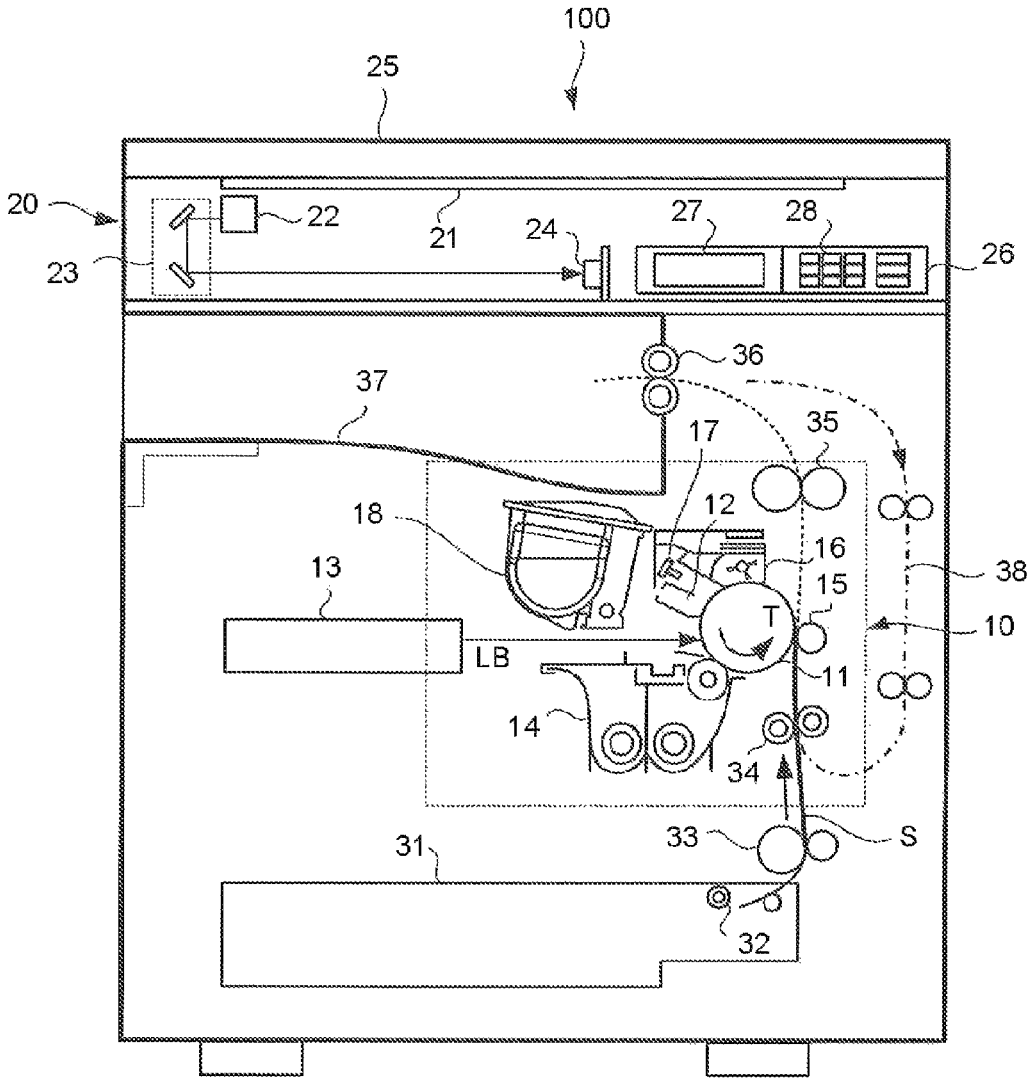
FIG. 1 is a diagram illustrating an image forming apparatus provided with a toner container according to one embodiment.

In accordance with one embodiment, a toner container comprises a container main body configured to store toner and having a toner discharge port, a toner conveying section configured to stir toner in the container main body and to convey toner in a longitudinal direction of the container main body to the toner discharge port, the toner conveying section including an auger arranged in the container main body to extend in the longitudinal direction and a mixer arranged parallel to the auger in the container main body, a handle positioned at a first end portion of the container main body, a toner filling port positioned at a second end portion of the container main body, the second end portion being on an opposite side of the container main body from the first end portion in the longitudinal direction of the container main body, a cap covering the toner filling port, a cylindrical supporting section positioned at a central part of the cap, a first gear positioned at one end portion of the mixer and configured to rotate the mixer and having a rotary axis inserted into the cylindrical supporting section, a coupling member configured to transmit rotation force from a driving device to the auger, and a second gear which rotates with the coupling member and is engaged with the first gear so that the first gear rotates when the driving device transmits rotation force from the driving device.

Hereinafter, an image forming apparatus according to the embodiment is described in detail with reference to the accompanying drawings. In addition, the same components in each figure are applied with the same reference numerals.

A First Embodiment

FIG. 1 is a diagram illustrating an image forming apparatus 10 provided with a toner container 18 according to the embodiment. The image forming apparatus 100 is, for example, a copier, a printer, an MFP, i.e., multi-functional peripheral, and the like. Though the copier is exemplified in the following description, the printer, MFP and the like are also applicable.

The copier 100 is provided with an image forming section 10 at the central part thereof. The image forming section 10 includes a rotatable photoconductive drum 11. The photoconductive drum 11 serves as an image carrier and in includes photoconductor on the outer circumference. If the photoconductive drum 11 is irradiated with light in a state in which a given potential is applied to the photoconductive drum 11, the potential of an area irradiated with light changes, and the change of potential is maintained for a given time as an electrostatic latent image.

An electrostatic charger 12, an exposure unit 13, a developer 14, a transfer roller 15, a drum cleaner 16 and a charge removing lamp 17 are arranged around the photoconductive drum 11 along a rotation direction T of the photoconductive drum 11.

The electrostatic charger 12 charges the surface of the photoconductive drum 11 to a given potential. The exposure unit 13 exposes the photoconductive drum 11 by irradiating the photoconductive drum 11 with laser beam LB to form the electrostatic latent image on the surface of the photoconductive drum 11. The laser beam LB changes the strength of the light according to the concentration of the image and the like.

The developer 14 stores a two-component developing agent, which includes carrier and toner. The developer supplies the developing agent to the surface of the photoconductive drum 11 to develop the electrostatic latent image of the photoconductive drum 11. A toner image is formed over the electrostatic latent image on the surface of the photoconductive drum 11. The transfer roller 15 applies a given potential to a paper S serving as an image receiving medium to transfer the toner image on the photoconductive drum 11 to the paper S. The drum cleaner 16 removes and collects residual toner and the like left on the surface of the photoconductive drum 11. The charge removing lamp 17 removes the charge left on the photoconductive drum 11.

Further, t toner container 18 for storing toner is arranged above the developer 14. If the toner in the developer 14 is consumed, the developer 14 is replenished with toner from the toner container 18. The toner container 18 can be exchanged.

A scanner 20 is arranged at the upper portion of the copier 100. The scanner 20 reads an original placed on an original placing table 21. The scanner 20 includes a light source 22, a reflecting mirror 23 and a light receiving element 24. The light source 22 irradiates the original placed on the original placing table 21 with light. The reflecting mirror 23 reflects light reflected from the original to guide the reflected light to the light receiving element 24. Further, a cover 25 and an operation panel 26 are arranged above the original placing table 21. The operation panel 26 includes a touch panel type display section 27 and an operation section 28.

A paper feed cassette 31 is arranged at the lower portion of the copier 100. A plurality of paper feed cassettes 31 may be arranged according to the size of paper. The paper S (image receiving medium) in the paper feed cassette 31 is conveyed upward by a pickup roller 32, an aligning roller 33 and a register roller 34. In addition, the paper S is discharged to the paper discharge tray 37 by a fixing roller 35 and a paper discharge roller 36.

The pickup roller 32 picks up the paper S in the paper feed cassette 31 one by one and conveys the paper S to the aligning roller 33. To align the positions of the paper S and the toner image formed on the photoconductive drum 11, the aligning roller 33 rotates at given timing. The paper S is conveyed to the transfer position by the aligning roller 33 and the register roller 34.

The fixing roller 35 heats and presses the paper S on which the toner image is transferred by the transfer roller 15 to fix the toner image to the paper S. The paper discharge roller 36 conveys the paper S discharged from the fixing roller 35 to the paper discharge tray 37.

During the image forming process, the original placed on the original placing table 21 is irradiated with light from the light resource 22. The irradiating light is reflected by the original. The light reflected by the original enters the light receiving element 24 through the reflecting mirror 23. The light receiving element 24 reads an original image. The laser beam LB is output from the exposure unit 13 based on information read by the light receiving element 24 or the image information supplied from external device such as a PC (Personal Computer) and the like. The laser beam LB irradiates the surface of the photoconductive drum 11. The surface of the photoconductive drum 11 is negatively charged by the charging charger 12. Thus, the laser beam LB irradiates the exposure unit 13 to expose the photoconductive drum 11, and then the electrostatic latent image is formed on the surface of the photoconductive drum 11.

The electrostatic latent image formed on the photoconductive drum 11 is developed with toner by the developer 14 and becomes the toner image. Then if the paper S taken out from the paper feed cassette 31 is conveyed, the visible image on the photoconductive drum 11 is transferred to the paper S by the transfer roller 15. The paper S with the transferred image is conveyed to the fixing roller 35 and heated and pressed by the fixing roller 35 to fix the image on the paper S. The paper S on which the image is fixed is discharged to the paper discharge tray 37 through the paper discharge roller 36.

Further, a reversal conveyance path 38 is arranged at the downstream side of the fixing roller 35. The reversal conveyance path 38 reverses the paper S to guide it to the register roller 34. The paper S is further guided to the transfer roller 15, and a double-sided printing is carried out.

Figure 2:
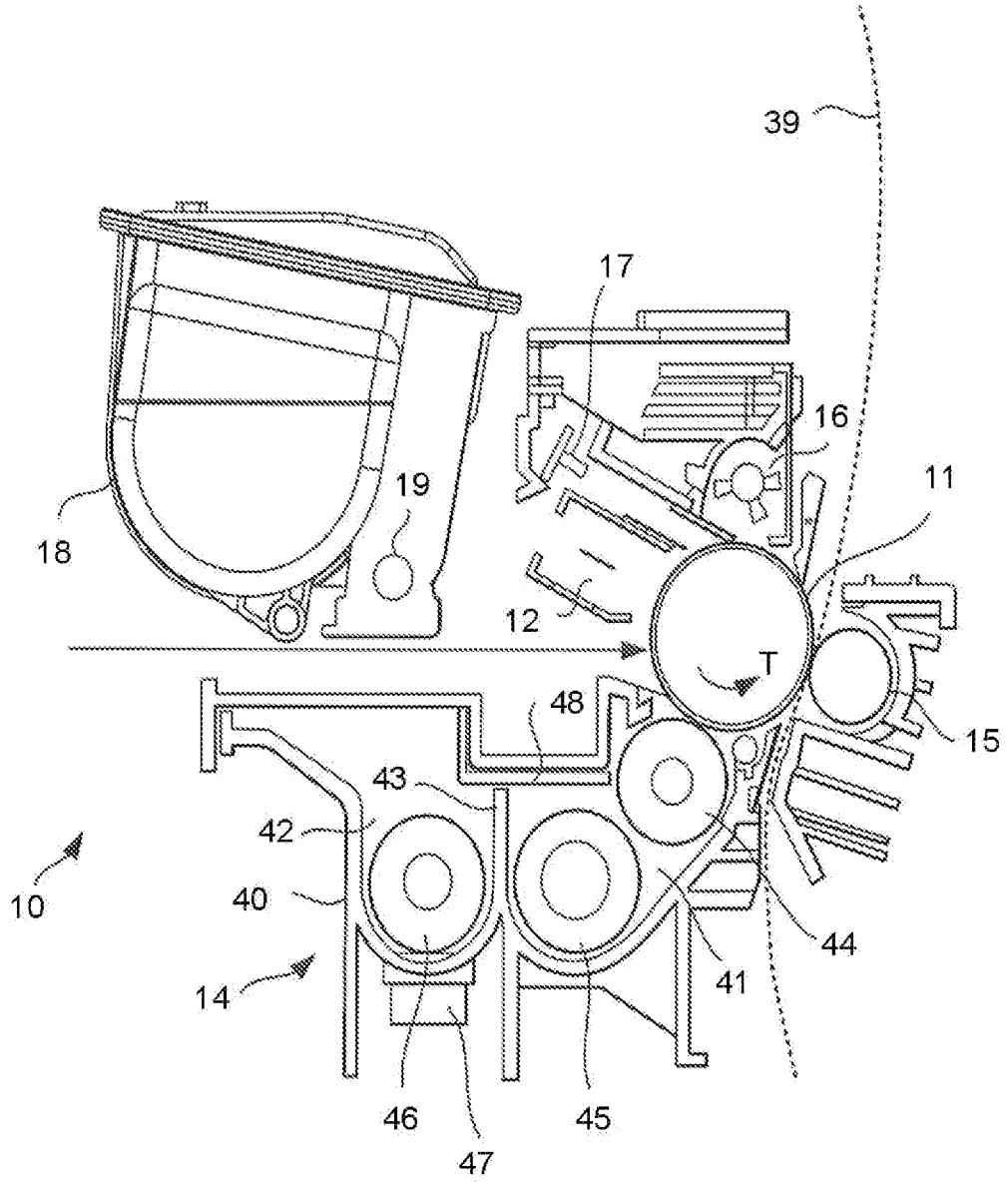
FIG. 2 is a diagram illustrating a front view of an image forming section, according to the embodiment.

FIG. 2 is a front view of the image forming section 10 as seen from the front side (nearer side) of the copier 100. In FIG. 2, a dotted line 39 indicates the conveyance path of the paper S. As shown in FIG. 2, the toner container 18 is positioned above the developer 14. The developer 14 is replenished with toner from the toner container 18. The toner container 18 includes a supplying section 19 which is rotated by a driving device. The toner is supplied to the developer 14 with the supplying section 19. The toner container 18 is exchanged by service personnel or a user. The toner container 18 is described later in detail.

The developer 14 is provided with a container 40 for storing the two-component developing agent (hereinafter referred to as developing agent). The container 40 includes chambers 41 and 42. A partition 43 is positioned to divide the container 40 into two chambers 41 and 42. The chamber 41 of the container 40 includes a developing roller 44 arranged facing the photoconductive drum 11 and a first mixer 45. The charging charger 12 is arranged around the photoconductive drum 11 at the upstream side of the developing roller 44. In addition, the transfer roller 15, the drum cleaner 16 and the charge removing lamp 17 are arranged at the downstream side of the developing roller 44, in sequence.

A second mixer 46 is arranged in the chamber 42 of the container 40, and a magnetic sensor 47 for detecting the density of the toner stored in the container 40 is also arranged in the chamber 42. It is preferable that the magnetic sensor 47 is arranged at the lower portion of the container 40. Further, a layer regulating blade 48 is arranged for the developing roller 44. The layer regulating blade 48 regulates the layer of the developing agent on the surface of the developing roller 44 to be not too thick.

Figure 3:
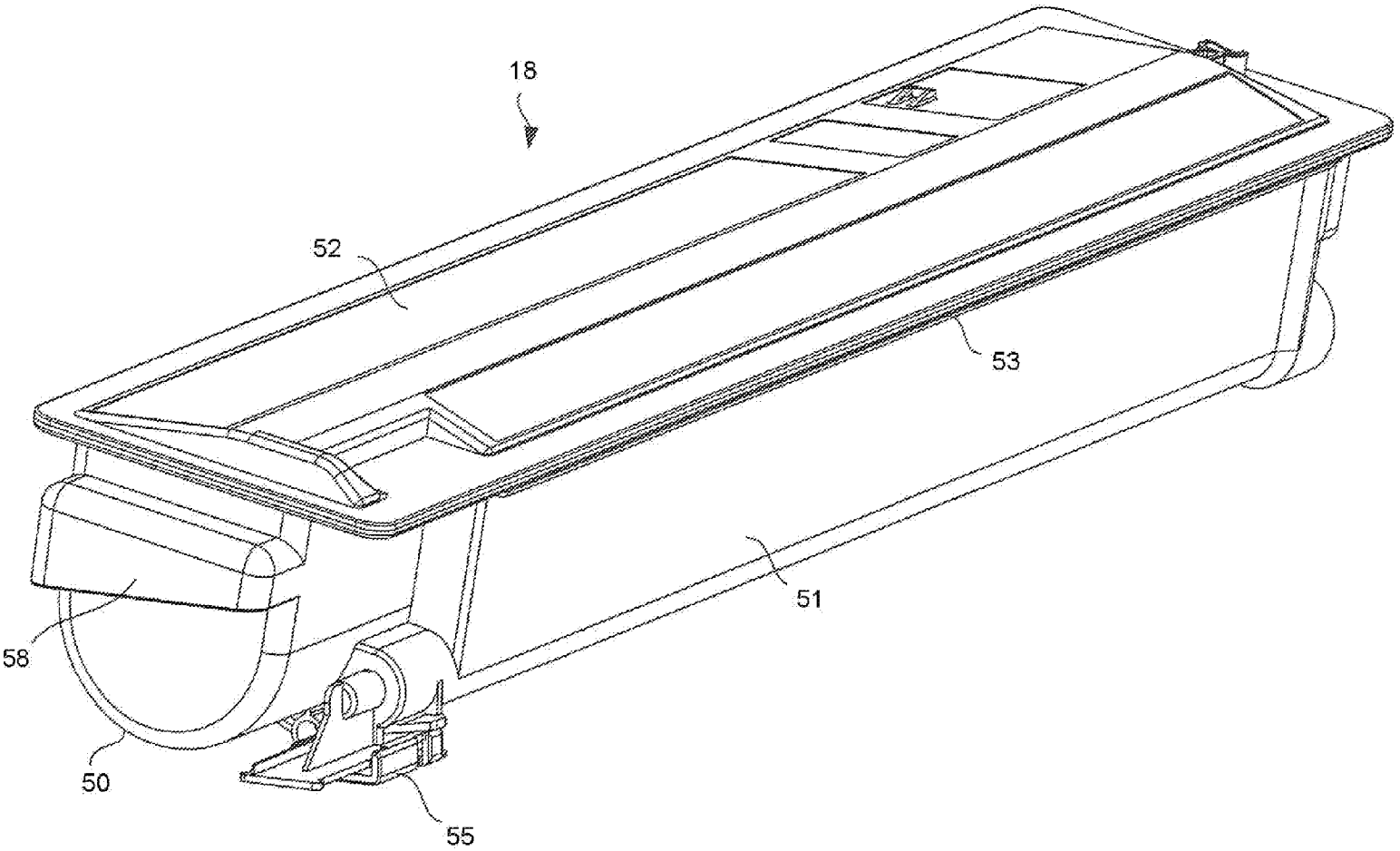
FIG. 3 is a perspective view illustrating the toner container.
Figure 4:
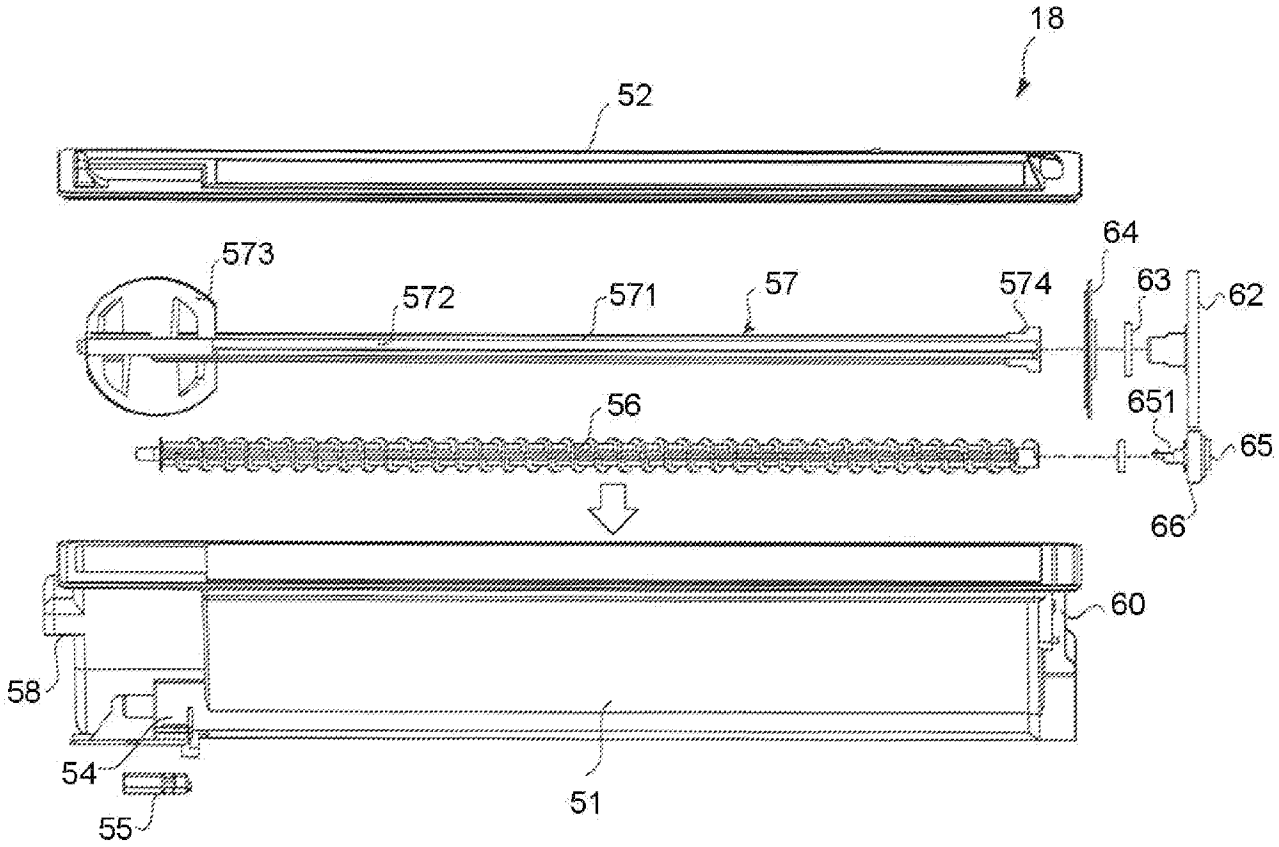
FIG. 4 is an exploded side view illustrating the toner container.

FIG. 3 is a perspective view illustrating the toner container 18 removed from the copier 100. FIG. 4 is an exploded side view illustrating the toner container 18.

The toner container 18 is formed of a material such as resin and the like. As shown in FIG. 3, the toner container 18 is provided with a toner container main body 50, including a lowercase 51 and an upper case 52. The toner container main body 50 generally forms a long box shape as a whole. Where the upper case 52 abuts the lower case 51, a rib 53 for joining the upper case 52 and the lowercase 51 is arranged. The rib 53 extends over the entire circumference of the toner container 18. The rib 53 serves as a sliding section when installing the toner container 18 in the copier 100 through sliding and insertion.

At the bottom of the lower case 51, a discharge port 54 (refer to FIG. 4) for discharging the toner in the toner container 18 to the developer 14 is formed. The discharge port 54 protrudes downward from the lower case 51. In addition, a shutter 55 for opening and closing the discharge port 54 in a movable manner is arranged.

Further, as shown in FIG. 4, an auger 56 and a mixer 57 for stirring toner are arranged in the lower case 51. That is, one end portion of the stick-shaped auger 56 is positioned at a position facing the discharge port 54 at the bottom of the lower case 51. The auger 56 is arranged along the longitudinal direction in the toner container main body 50 and arranged near the bottom of the lower case 51. Both ends in the longitudinal direction of the auger 56 are supported by the lower case 51 in a rotatable manner. Through the rotation of the auger 56, the toner in the toner container 18 is conveyed to the discharge port 54.

In addition, the mixer 57 for stirring the toner in the toner container 18 is arranged along the longitudinal direction in the toner container 18. Two end portions in the longitudinal direction of the mixer 57 are supported by the upper portion of the lower case 51 in a rotatable manner. The mixer 57 is arranged parallel to and above the auger 56.

The mixer 57 includes a rotary axis 571, and further includes a paddle part 572 and a spiral conveying blade 573 arranged on the rotary axis 571. The paddle part 572 is formed by assembling multiple rod-shaped members in a truss shape. The conveying blade 573 feeds toner towards the discharge port 54. The mixer 57 and the auger 56 constitute the supplying section 19 shown in FIG. 2. The mixer 57 sends the toner in the toner container main body 50 to the discharge port 54 while stirring the toner to supply the toner to the developer 14.

As shown in FIG. 3, a handle 58 is arranged at one end portion on the front side in the longitudinal direction of the toner container main body 50. The user can pull out the toner container 18 from the copier 100 by hooking a finger on the handle 58 and pulling out the handle 58. In addition, the toner container 18 can be inserted into the copier 100 by pushing the handle 58.

Figure 5:
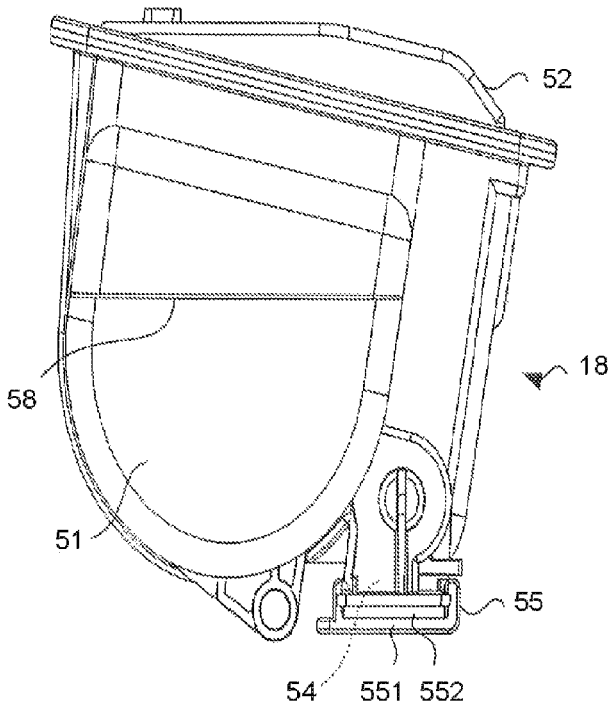
FIG. 5 is a front view of the toner container.
Figure 6:
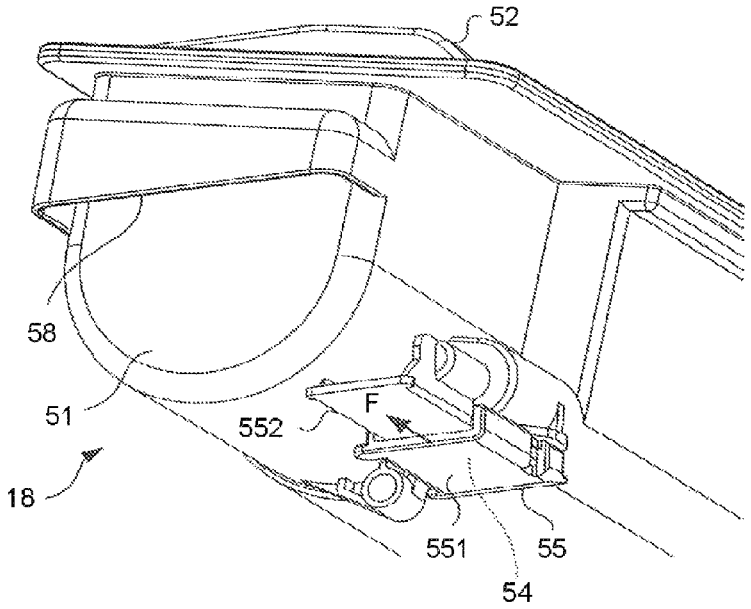
FIG. 6 is a perspective view illustrating the front side of the toner container.

FIG. 5 is a front view of the toner container 18. FIG. 6 is a perspective view illustrating the front side of the toner container 18. As shown in FIG. 5 and FIG. 6, the handle 58 is formed on the front side of the toner container main body 50.

Further, as shown in FIG. 6, the shutter 55 includes a shutter member 551 and a guide member 552. The shutter member 551 is capable of moving along the guide member 552. FIG. 6 illustrates a state in which the discharge port 54 is covered with the shutter member 551. When the toner residual amount in the developer 14 is less than the amount set in advance, the shutter member 551 is controlled to move along the guide member 552. If the shutter member 551 is moved along the guide member 552 in the front direction (direction indicated by an arrow F), the discharge port 54 is opened. After the discharge port 54 is opened, the toner is discharged from the discharge port 54 and replenished to the developer 14.

Figure 7:
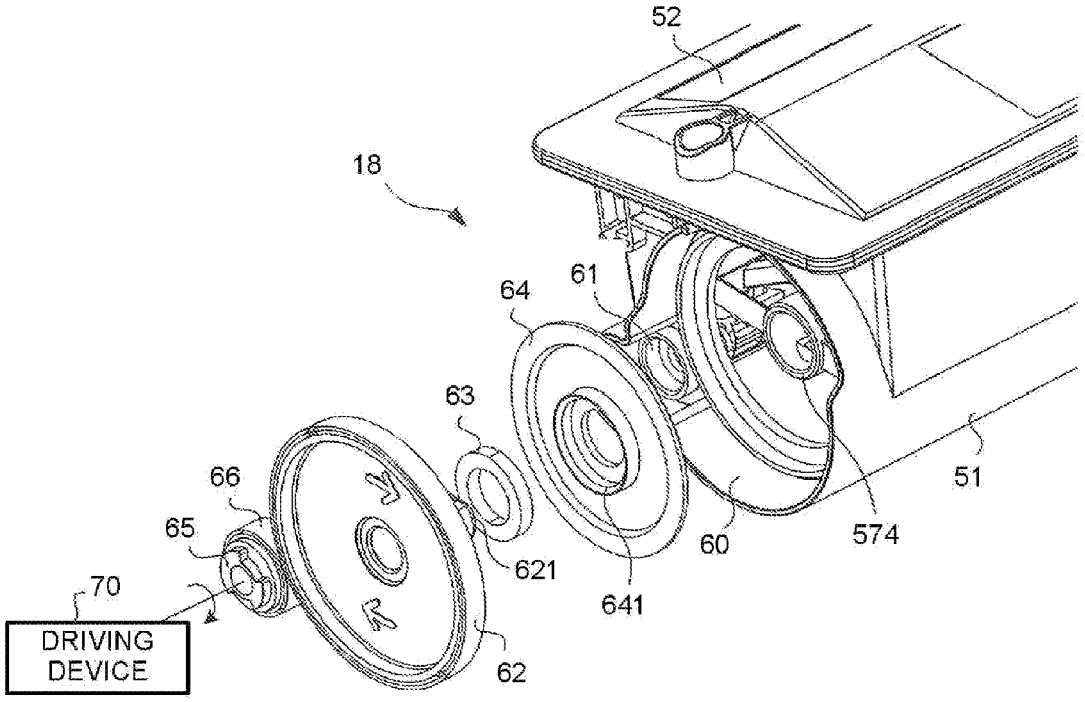
FIG. 7 is a partially exploded perspective view of the rear side of the toner container.
Figure 8:
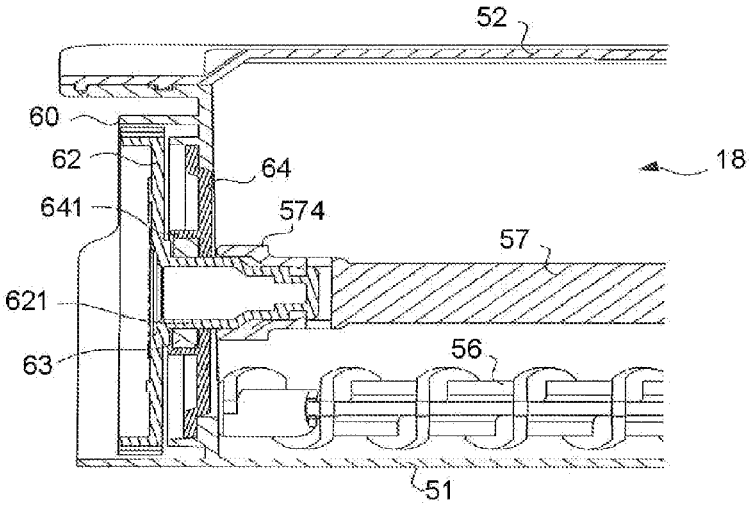
FIG. 8 is a sectional view illustrating the rear side of the toner container.

FIG. 7 is an exploded, perspective view illustrating the rear side of the toner container 18. FIG. 8 is a sectional view illustrating the rear side of the toner container 18.

In FIG. 7, a cylindrical toner filling port 60 is formed at an end portion on the rear side in the longitudinal direction of the lower case 51. An end portion 574 on the rear side of the mixer 57 can be seen through the toner filling port 60. In addition, a small cylindrical section 61 adjacent to the toner filling port 60 is formed. A rotary axis 621 of a mixer gear 62 (first gear) having a large diameter is inserted into the end portion 574 on the rear side of the mixer 57.

Further, a seal material 63 and a disk-shaped cap 64 are arranged on the outer periphery of the rotary axis 621 of the mixer gear 62. The cap 64 is used to cover the toner filling port 60. The seal material 63 is used to prevent toner leakage. The cap 64 is used to cover the toner filling port 60 as well as support the mixer gear 62.

Further, a coupling member 65 is arranged on an end portion of the rear side in the longitudinal direction of the auger 56. The coupling member 65 is connected to a driving device 70 arranged in the main body of the copier 100. A rotary axis 651 (FIG. 4) of the coupling member 65 is inserted into the cylindrical section 61, and coupled with one end of the auger 56. Thus, if the coupling member 65 is rotated by the driving device 70, the auger 56 is also rotated.

An auger gear 66 (second gear) is formed on the outer periphery of the coupling member 65. The auger gear 66 is engaged with the mixer gear 62. If the coupling member 65 is rotated, the auger gear 66 is rotated, and the mixer gear 62 is also rotated. Further, the mixer 57 also rotates in interlock with the rotation of the mixer gear 62. Thus, the coupling member 65, the auger gear 66 and the mixer gear 62 constitute a transmission mechanism for transmitting rotation force from the driving device 70 to the auger 56 and the mixer 57.

As shown in FIG. 8, after toner is filled from the toner filling port 60, the toner filling port 60 is covered with the cap 64. Further, the seal material 63 is inserted on the inner periphery of a cylindrical supporting section 641 arranged at the central part of the cap 64. The rotary axis 621 of mixer gear 62 is inserted through the seal material 63 and the supporting section 641 of the cap 64. Then, the rotary axis 621, the seal material 63 and the supporting section 641 are then inserted into the end portion 574 of the mixer 57.

Figure 9:
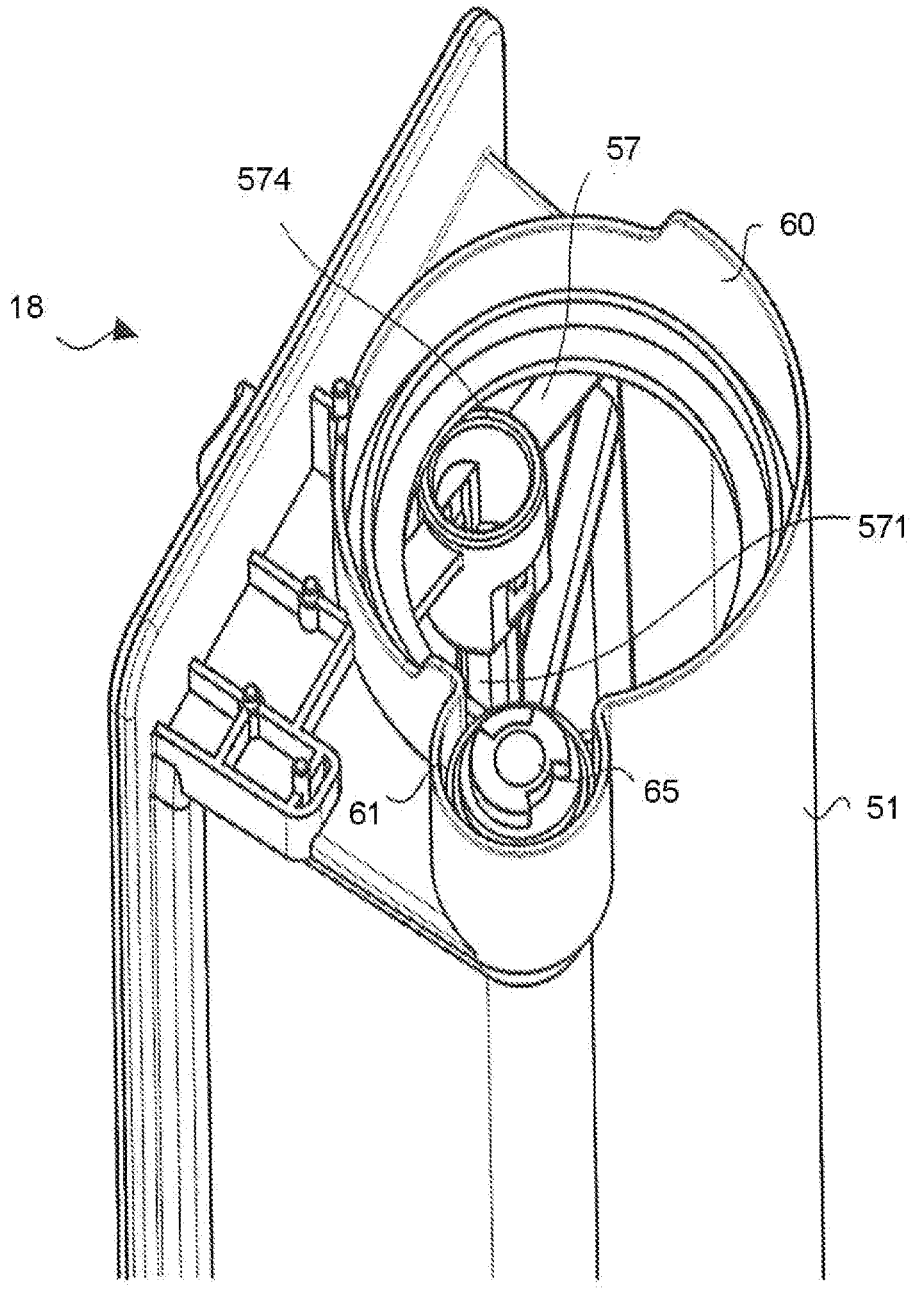
FIG. 9 is a perspective view of the toner container illustrating a toner filling port facing upward.

FIG. 9 is a perspective view illustrating a state in which the toner filling port 60 of the toner container 18 faces upward. In a case of filling the toner container 18 with toner, the cap 64 and the mixer gear 62 have not been installed yet. If the mixer 57 is inclined so that the handle 58 faces down, the filling port can be securely positioned for filling. After the filling port is secured, toner is filled from the toner filling port 60. The toner filling port 60 is formed with a large opening on the end portion of the rear side of the toner container main body 50. Thus, the toner can be filled smoothly.

After toner is filled, the toner filling port 60 is covered with the cap 64 as shown in FIG. 8. In addition, the seal material 63 is fitted into the supporting section 641 of the cap 64. Further, the rotary axis 621 of the mixer gear 62 is inserted in such a manner so as to extend through the seal material 63 and the supporting section 641 to couple with the end portion 574 of the mixer 57. Finally, the cap 64 is attached (e.g., welded) to the toner container main body 50, and then the assembling process is completed.

Further, the replenishment of toner to the toner container 18 is carried out during the manufacturing process of the toner container 18. In addition, when the toner amount in the toner container 18 loaded in the copier 100 becomes depleted, the toner container 18 is pulled out by hooking a finger on the handle 58 arranged on the front side thereof. Then, the toner container 18 is exchanged with a new toner container.

As stated above, in the present embodiment, the handle 58 is arranged on the front side of the toner container main body 50, and the toner filling port 60 is arranged on the rear side of the toner container main body 50, individually. Thus, even if the toner container 18 is set small, the toner filling port 60 can have a large opening on the rear side of the toner container main body 50. Thus, the toner can be filled smoothly. In addition, the handle 58 can also be sufficiently large on the front side of the toner container main body 50. In this way, the insertion and removal of the toner container 18 can be easily carried out, and the operability can be improved.

Further, the present invention is not limited to the embodiment described above, various applications are possible. For example, the present invention may be an image forming apparatus including a plurality of color developing units. In this case, there will be four toner containers. In addition, a scanning head including an LED element can also be used instead of the exposure unit 13 including a laser light source.

Further, in the examples shown in FIG. 5 and FIG. 6, it is exemplified that the handle 58 is the configuration in which the user's finger is inserted from the bottom side thereof. However, the handle 58 is not limited to the examples shown in the figures, and it may be a configuration in which the user's finger is inserted from the top or horizontal direction thereof.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A toner container, comprising:

a container main body configured to store toner and having a toner discharge port;

a toner conveying section configured to stir toner in the container main body and to convey toner in a longitudinal direction of the container main body to the toner discharge port, the toner conveying section including an auger arranged in the container main body to extend in the longitudinal direction and a mixer arranged parallel to the auger in the container main body;

a handle positioned at a first end portion of the container main body;

a toner filling port positioned at a second end portion of the container main body, the second end portion being on an opposite side of the container main body from the first end portion in the longitudinal direction of the container main body;

a cap covering the toner filling port;

a cylindrical supporting section positioned at a central part of the cap;

a first gear positioned at one end portion of the mixer and configured to rotate the mixer and having a rotary axis inserted into the cylindrical supporting section;

a coupling member configured to transmit rotation force from a driving device to the auger; and a second gear which rotates with the coupling member and is engaged with the first gear so that the first gear rotates when the driving device transmits rotation force from the driving device.

2. The toner container according to claim 1, further comprising:

a seal material positioned outside of the rotary axis of the first gear and inside of the cylindrical supporting section of the cap and configured to prevent toner leakage.

3. The toner container according to claim 1, wherein the toner discharge port is positioned at the first end portion of the container main body.

4. The toner container according to claim 3, further comprising:

a shutter configured to open and close the toner discharge port.

5. The toner container according to claim 1, wherein the handle extends from the first end portion of the container main body and is shaped and configured so that a user's finger can be inserted into it.

6. An image forming apparatus, comprising:

an image carrier on which an electrostatic latent image is formed;

a developer configured to supply developing agent to the image carrier to form a toner image;

a toner container configured to supply toner to the developer, the toner container including:

a container main body configured to store toner and having a toner discharge port, a toner conveying section configured to stir toner in the container main body and to convey toner in a longitudinal direction of the container main body to the toner discharge port, the toner conveying section including an auger arranged in the container main body to extend in the longitudinal direction and a mixer arranged parallel to the auger in the container main body, a handle positioned at a first end portion of the container main body, a toner filling port positioned at a second end portion of the container main body, the second end portion being on an opposite side of the container main body from the first end portion in the longitudinal direction of the container main body, a cap covering the toner filling port, a cylindrical supporting section positioned at a central part of the cap, a first gear positioned at one end portion of the mixer and configured to rotate the mixer and having a rotary axis inserted into the cylindrical supporting section, a coupling member configured to transmit rotation force from a driving device to the auger, and a second gear which rotates with the coupling member and is engaged with the first gear so that the first gear rotates when the driving device transmits rotation force from the driving device; and a transfer device configured to transfer the toner image formed on the image carrier with the developer to a recording medium.

7. The image forming apparatus according to claim 6, wherein the toner container further includes:

a seal material positioned outside of the rotary axis of the first gear and inside of the cylindrical supporting section of the cap and configured to prevent toner leakage.

8. The image forming apparatus according to claim 6, wherein the toner discharge port is positioned at the first end portion of the container main body.

9. The image forming apparatus according to claim 8, wherein the toner container further includes:

a shutter configured to open and close the toner discharge port according to the toner residual amount in the developer.

10. The image forming apparatus according to claim 6, wherein the handle extends from the first end portion of the container main body and is shaped and configured so that a user's finger can be inserted into it.

* * * * *